US007618229B2

(12) United States Patent
Boling et al.

(10) Patent No.: US 7,618,229 B2
(45) Date of Patent: Nov. 17, 2009

(54) BOOM LOCK FOR WORK MACHINE AND ASSOCIATED METHOD

(75) Inventors: John R. Boling, Dubuque, IA (US); Michael R. Tigges, Dubuque, IA (US)

(73) Assignee: Deere & Company, Moline, IL (US)

( * ) Notice: Subject to any disclaimer, the term of this patent is extended or adjusted under 35 U.S.C. 154(b) by 159 days.

(21) Appl. No.: 11/768,966

(22) Filed: Jun. 27, 2007

(65) Prior Publication Data

US 2009/0000158 A1 Jan. 1, 2009

(51) Int. Cl.
*E02F 9/24* (2006.01)

(52) U.S. Cl. ..... 414/685; 172/466

(58) Field of Classification Search ..... 414/680, 414/685; 212/222; 172/466, 481
See application file for complete search history.

(56) References Cited

U.S. PATENT DOCUMENTS 3,730,362 A * 5/1973 Hurlburt et al. ..... 414/697
3,995,761 A * 12/1976 Hurlburt ..... 414/713
4,039,093 A * 8/1977 Schmitz et al. ..... 414/680
4,184,803 A 1/1980 Housman
4,206,848 A 6/1980 Wiese et al.
4,220,170 A 9/1980 Hebert et al.
4,225,282 A 9/1980 Nordstrom et al.
4,227,852 A 10/1980 Schmitz et al.
4,260,321 A 4/1981 Beauchamp et al.
4,273,502 A 6/1981 Maurer et al.
4,278,394 A 7/1981 Johnson
4,304,520 A 12/1981 Schmitz
4,370,090 A 1/1983 Shumaker et al.
4,379,522 A 4/1983 Elliott et al.
4,384,817 A 5/1983 Peterson
4,385,863 A 5/1983 Minor
4,389,154 A 6/1983 Minor et al.
4,417,502 A 11/1983 Shore
4,459,786 A 7/1984 Pitman et al.
4,636,132 A 1/1987 Menke et al.
4,724,989 A 2/1988 Silberberg
4,887,938 A 12/1989 Menke
4,997,333 A 3/1991 Ball et al.
5,052,566 A 10/1991 Ziegler
5,054,989 A 10/1991 Fell
5,064,339 A 11/1991 Ahlers
5,169,277 A 12/1992 Orser et al.
5,189,817 A 3/1993 Schroeder
5,333,333 A 8/1994 Mah
5,377,767 A 1/1995 Briggs
5,466,113 A 11/1995 Norberg
5,518,358 A 5/1996 Aschroft et al.
5,520,500 A 5/1996 McIlwain et al.
5,630,547 A 5/1997 Klemenhagen et al.
5,658,201 A 8/1997 Kleimeyer et al.
5,827,124 A 10/1998 Kleimeyer et al.
5,950,926 A 9/1999 Chahley et al.
5,967,737 A 10/1999 Kraske et al.

(Continued)

OTHER PUBLICATIONS

Images of Deere Skid Steer Model 240 (3 sheets) (2003).

(Continued)

*Primary Examiner*—Donald Underwood

(57) ABSTRACT

A work machine has a boom and a boom lock. The boom lock is arranged to lock the boom in a raised boom position. An associated method is disclosed.

19 Claims, 8 Drawing Sheets

U.S. PATENT DOCUMENTS

| | | | |
|---|---|---|---|
| 5,989,127 | A | 11/1999 | Kitchen et al. |
| 6,012,648 | A | 1/2000 | Morris |
| 6,059,512 | A | 5/2000 | Kielinski |
| 6,099,419 | A | 8/2000 | Incaudo et al. |
| 6,152,675 | A | 11/2000 | Compton |
| 6,254,331 | B1 | 7/2001 | Pisco et al. |
| 6,276,666 | B1 | 8/2001 | Roberts |
| 6,330,951 | B1 | 12/2001 | Johnston |
| 6,533,527 | B1 | 3/2003 | Inoue et al. |
| 6,648,582 | B2 | 11/2003 | Mayer et al. |
| 6,685,038 | B1 | 2/2004 | Johnston et al. |
| 6,752,541 | B1 | 6/2004 | Dykyk |
| 7,044,315 | B2 | 5/2006 | Willim |
| 7,051,634 | B1 | 5/2006 | Chubb et al. |
| 7,153,084 | B2 | 12/2006 | Horst et al. |

OTHER PUBLICATIONS

Images of Deere Skid Steer Model 250 (3 sheets) (2003).
Images of Deere Skid Steer Model 260 (2 sheets) (2003).
Images of Deere Skid Steer Model 270 (3 sheets) (2003).
Images of Deere Skid Steer Model 280 (1 sheet) (2003).
Lift Locks for Deere Skid Steer Models 240 & 250 (1 sheet) (2002).
Lift Locks for Deere Skid Steer Models 260, 270, & 280 (1 sheet) (2002).
Drawing of Boom Lock (7 pages) (2002).

* cited by examiner

BOOM LOCK FOR WORK MACHINE AND ASSOCIATED METHOD

FIELD OF THE DISCLOSURE

The present disclosure relates to a boom lock for locking a boom of a work machine.

BACKGROUND OF THE DISCLOSURE

There are work machines, such as, for example, skid steers, which have a boom coupled at one end to a machine body and at an opposite free end to an attachment for manipulating the attachment relative to the machine body. Typically, the boom can be moved up and down between a lowered boom position and a raised boom position by use of one or more boom actuators (e.g., hydraulic cylinders). At times, an operator of the work machine may wish to enter or exit an operator's station of the work machine while the boom is in the raised boom position.

SUMMARY OF THE DISCLOSURE

According to the present disclosure, there is provided a boom lock for locking a boom of a work machine in a raised boom position. In an aspect of the present disclosure, the boom lock comprises a brace and a brace activator. The brace is provided for acting mechanically between a mount of a machine body of the work machine and the boom to lock the boom in the raised boom position. The brace activator is operable from an operator's station of the machine body to initiate operation of the brace to lock the boom in the raised boom position.

In another aspect of the present disclosure, the boom lock comprises a brace, a brace retainer, and a retainer actuator. The brace is movable to a boom-locking position in response to movement of the boom. When positioned in the boom-locking position, the brace is arranged to lock the boom in the raised boom position. The brace retainer is engageable with the brace for retaining the brace in the boom-locking position during a partial lowering of the boom to the raised boom position. The retainer actuator is operable from the operator's station to actuate the brace retainer to retain the brace in the boom-locking position. In this way, the machine operator can actuate the boom lock to lock the boom in the raised position while remaining in the operator's station.

In yet another aspect of the present disclosure, an associated method is disclosed. Exemplarily, the method comprises actuating a brace retainer from the operator's station, retaining a brace in a boom-locking position using the brace retainer during a partial lowering of the boom onto the brace, and locking the boom in the raised boom position using the brace in its boom-locking position.

The above and other features will become apparent from the following description and the attached drawings.

BRIEF DESCRIPTION OF THE DRAWINGS

The detailed description of the drawings refer to the accompanying figures in which.

DETAILED DESCRIPTION OF THE DRAWINGS

Figure 1:
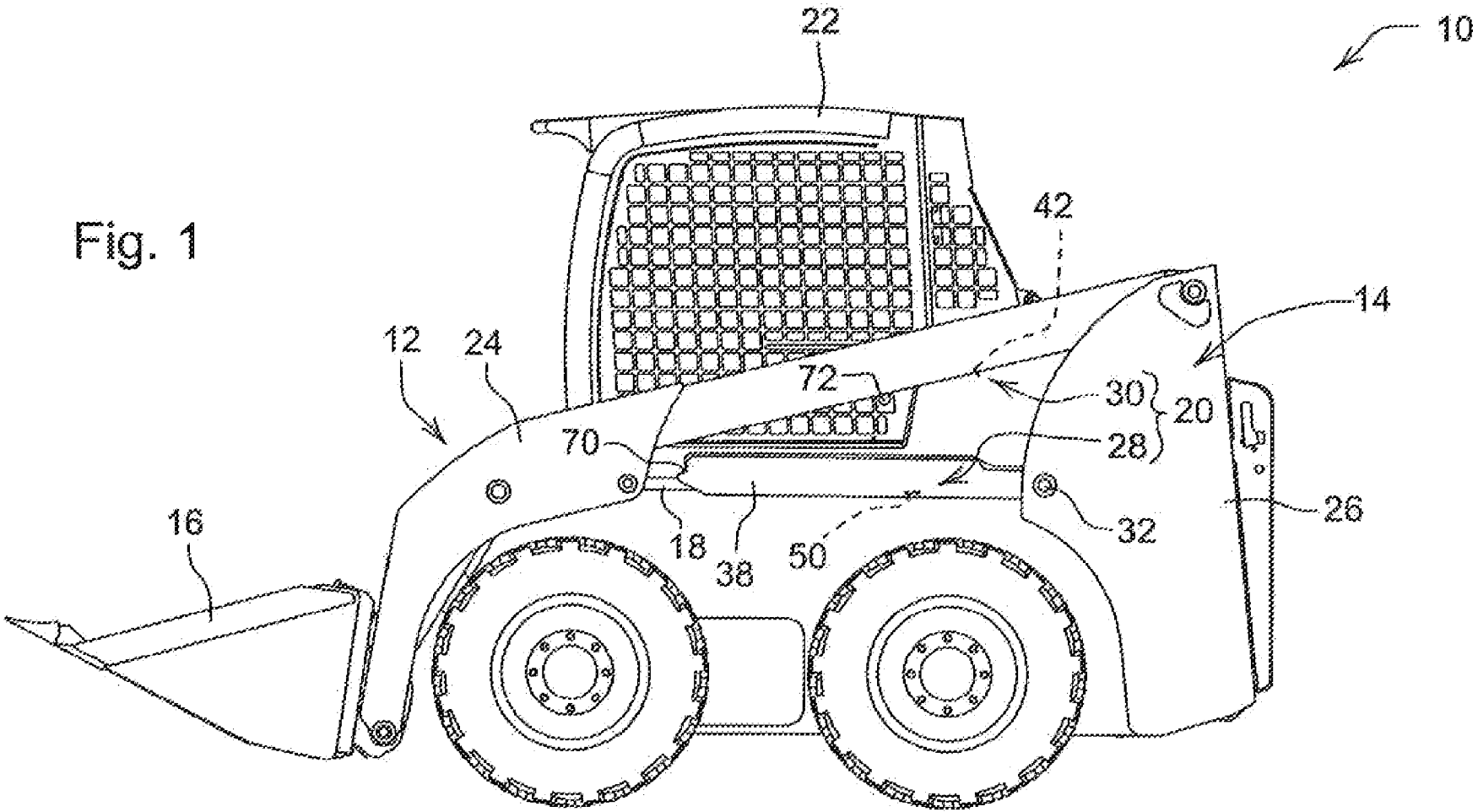
FIG. 1 is side elevation view of a work machine, in the form of, for example, a skid steer, with the boom of the work machine is lowered boom position.
Figure 2:
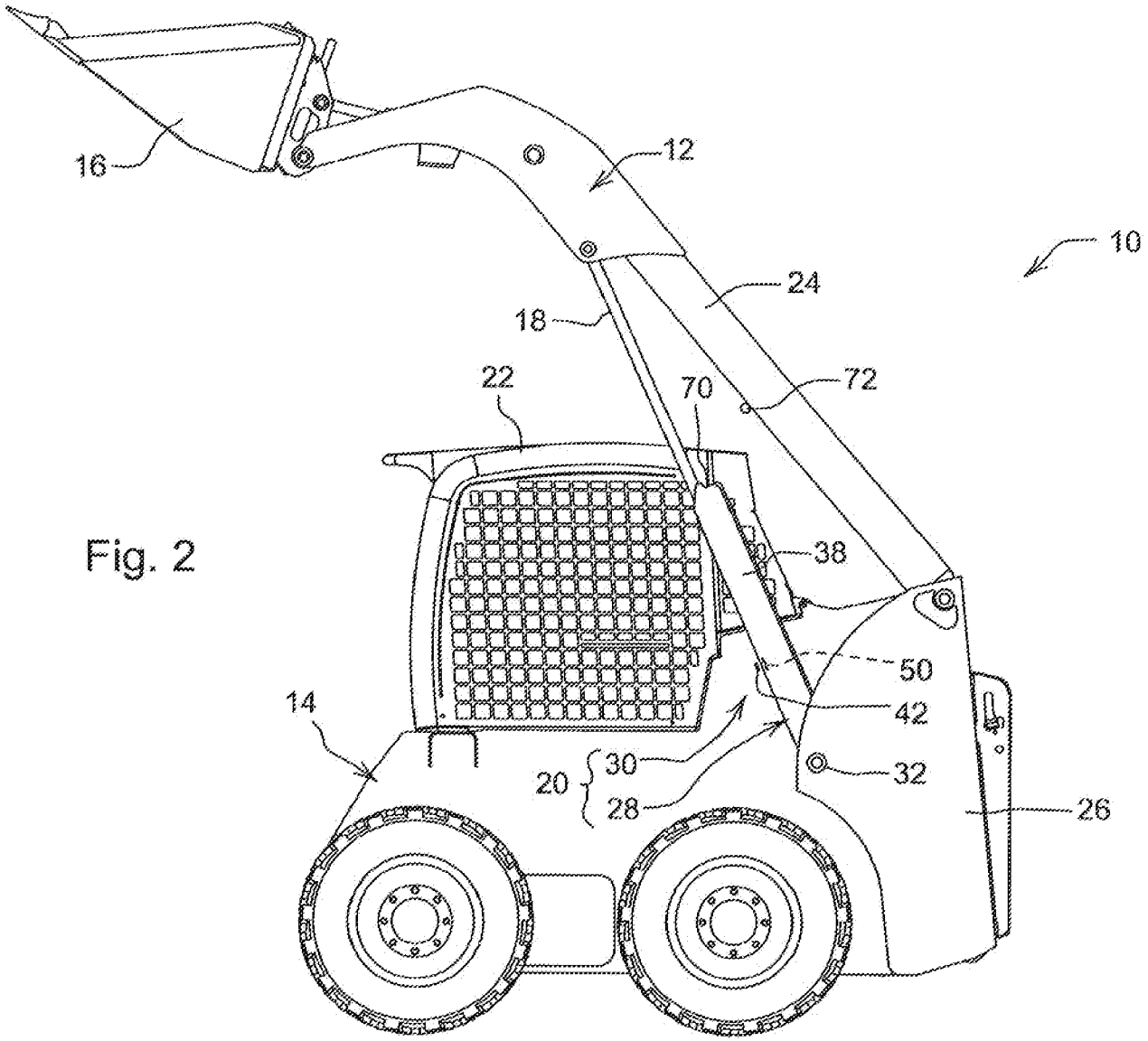
FIG. 2 is a side elevation view of the work machine showing the boom in a first boom raised position.

Referring primarily to FIG. 1, there is shown a work machine 10 with a boom 12 coupled at one end to a machine body 14 and at an opposite, free end to an attachment 16 (e.g., bucket) for manipulating the attachment 16 relative to the machine body 14. The work machine 10 may be, for example, a skid steer (as illustrated) or other type of work machine with a boom. The elevation of the boom 12 can be changed between a lowered boom position (FIG. 1) and various raised boom positions (FIGS. 2, 5, and 7) by use of one or more boom actuators 18, such as hydraulic cylinders. A boom lock 20 is provided for locking the boom 12 in a raised boom position (FIGS. 7 and 8), and is operable by a human operator from the operator's station 22 of the machine body 14 of the work machine 10 (FIG, 4).

Referring primarily to FIGS. 24, to lock the boom 12 with the boom lock 20, the boom 12 is initially raised from the lowered boom position (FIG. 1) to a first boom raised position (FIGS. 24). In the skid steer example, the boom 12 has two side arms 24, one positioned laterally outwardly from each side of the operator's station 22. Each arm 24 is pivotally coupled to a respective mount 26 of the machine body 14. A boom actuator 18 (e.g., hydraulic cylinder) is provided for each side arm 24 to raise and lower the boom 12. Each boom actuator 18 is pivotally coupled to the respective side arm 24 and the respective mount 26.

Figure 7:
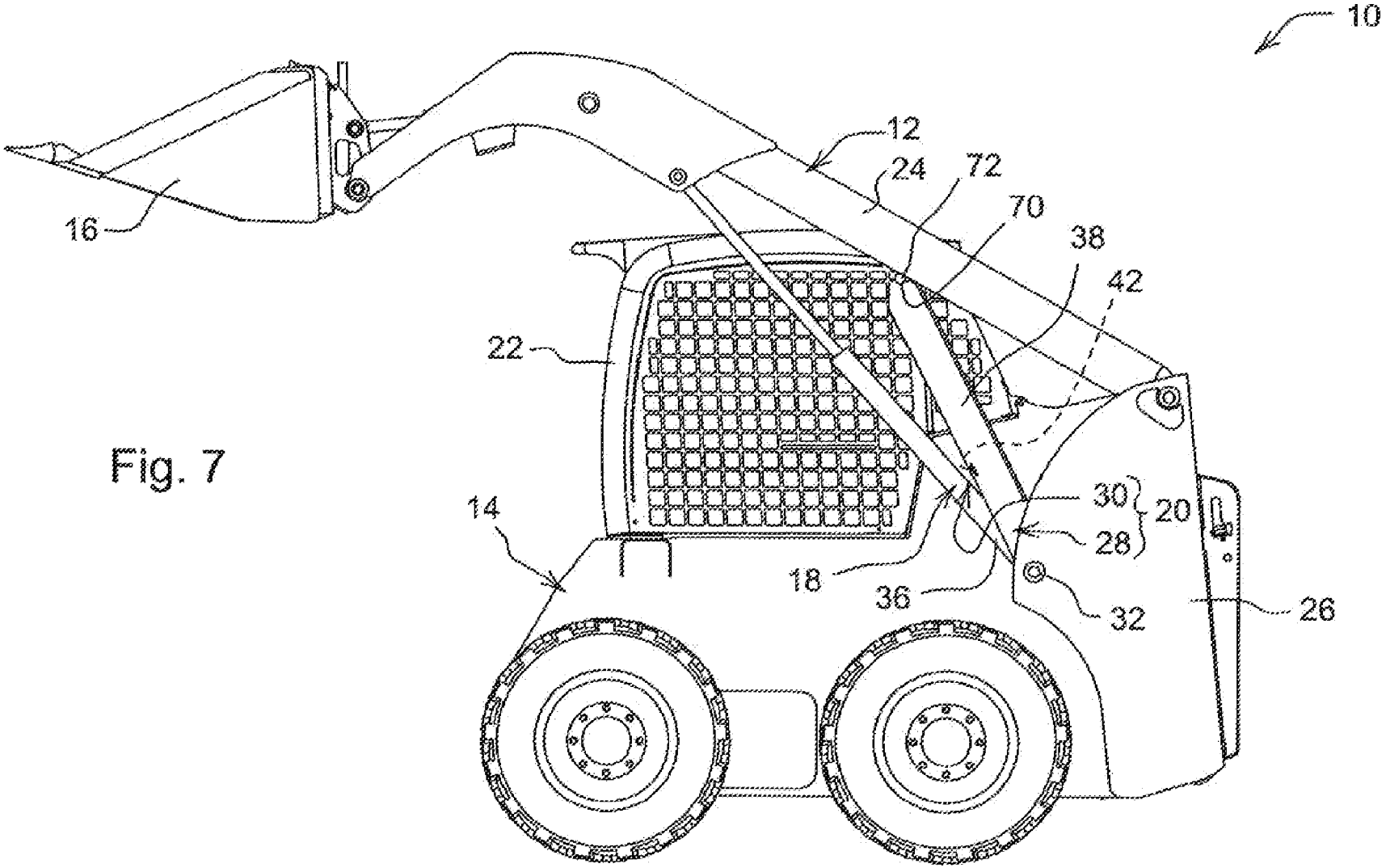
FIG. 7 is a side elevation view of the work machine showing the brace locking the boom in a second raised boom position after the partial lowering of the boom onto the brace.
Figure 8:
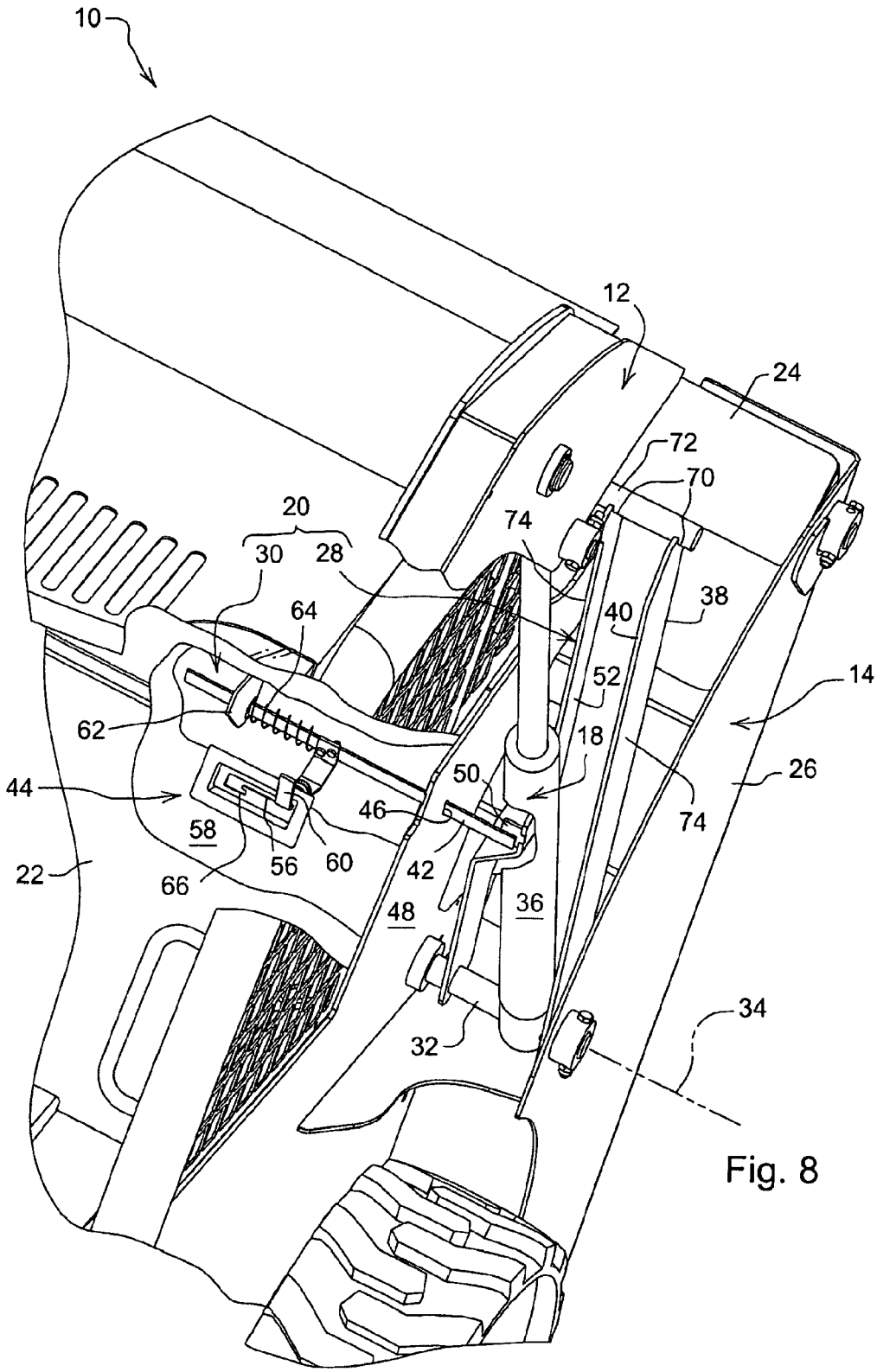
FIG. 8 is a perspective view, with portions broken away, showing the brace retained in the boom-locking position by the brace retainer so as to lock the boom in the second raised boom position.

The boom lock 20 has a brace 28 and a brace activator 30. Generally, the brace 28 is provided for acting mechanically between a mount 26 and the boom 12 to lock the boom 12 in a second raised boom position (FIGS. 7 and 8). The brace activator 30 is operable from the operator's station 22 to initiate operation of the brace 28 to lock the, boom 12 in the second raised boom position.

The brace 28 is pivotally coupled to a mount 26. Illustratively, the brace 28 is coupled to the same pivot 32 as an end of a boom actuator 18, for pivotal movement about a common pivot axis 34 upon lowering and raising of the boom 12. Except when activated, the brace 28 receives a barrel 36 of the boom actuator 18 in a channel 38 of the brace 28. When activated, the barrel 36 exits the channel 38 through a bottom opening 40 formed therein, as discussed in more detail below.

The brace activator 30 has a brace retainer 42 and a retainer actuator 44. Generally, the brace retainer 42 is engageable with the brace 28 for retaining the brace 28 in a boom-locking position (FIGS. 5-8) during a partial lowering of the boom 12 to a second raised boom position (FIGS. 7 and 8). The retainer actuator 44 is operable from the operator's station 22 to actuate the brace retainer 42 to retain the brace 28 in the boom-locking position.

Figure 3:
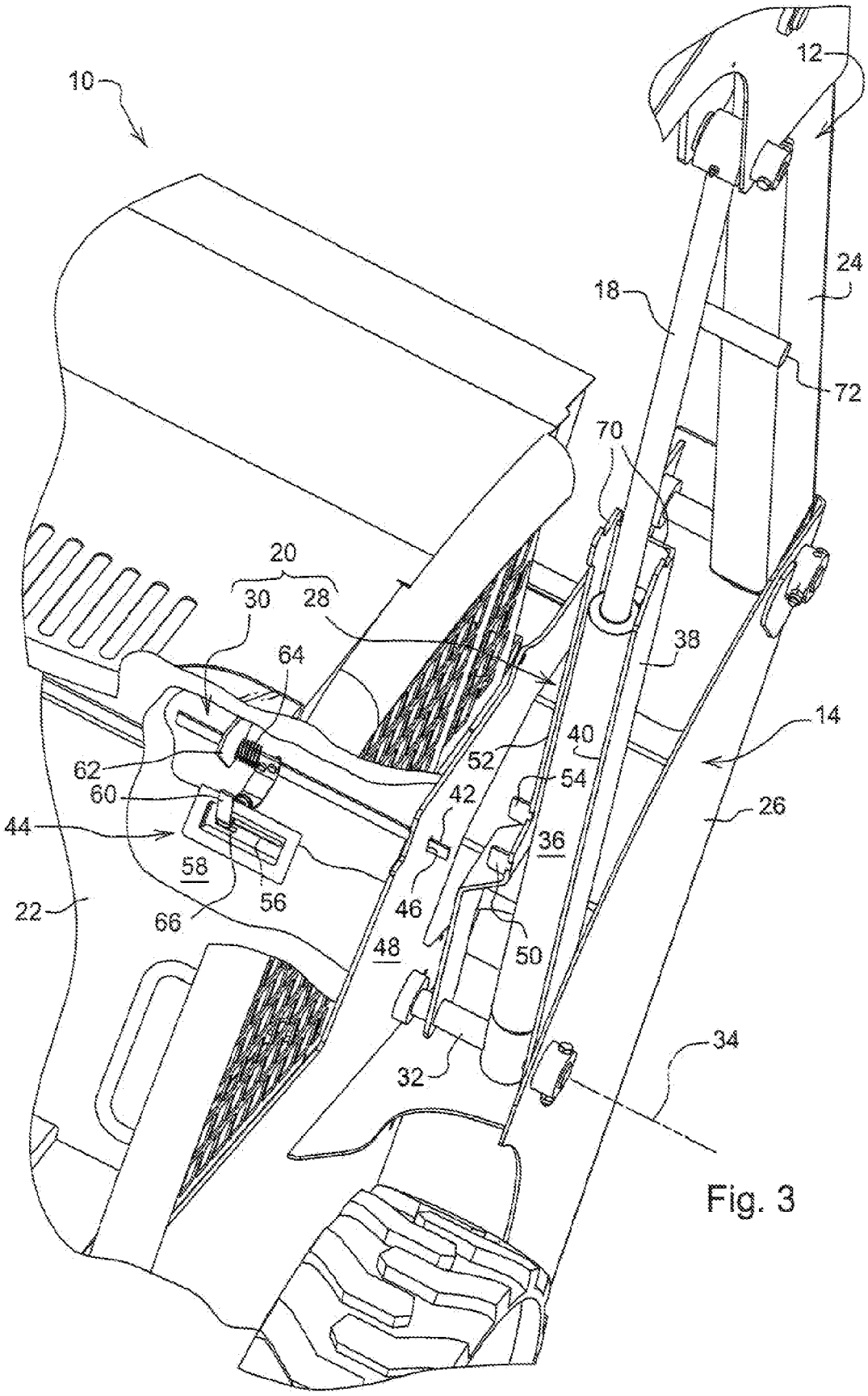
FIG. 3 is a perspective view, with portions broken away, showing the boom in the first raised boom position and a retainer actuator located in the operator's station and positioned so as to hold a brace retainer, in the form of, for example, a slidable bar, in a non-use position retracted relative to the machine body.
Figure 4:
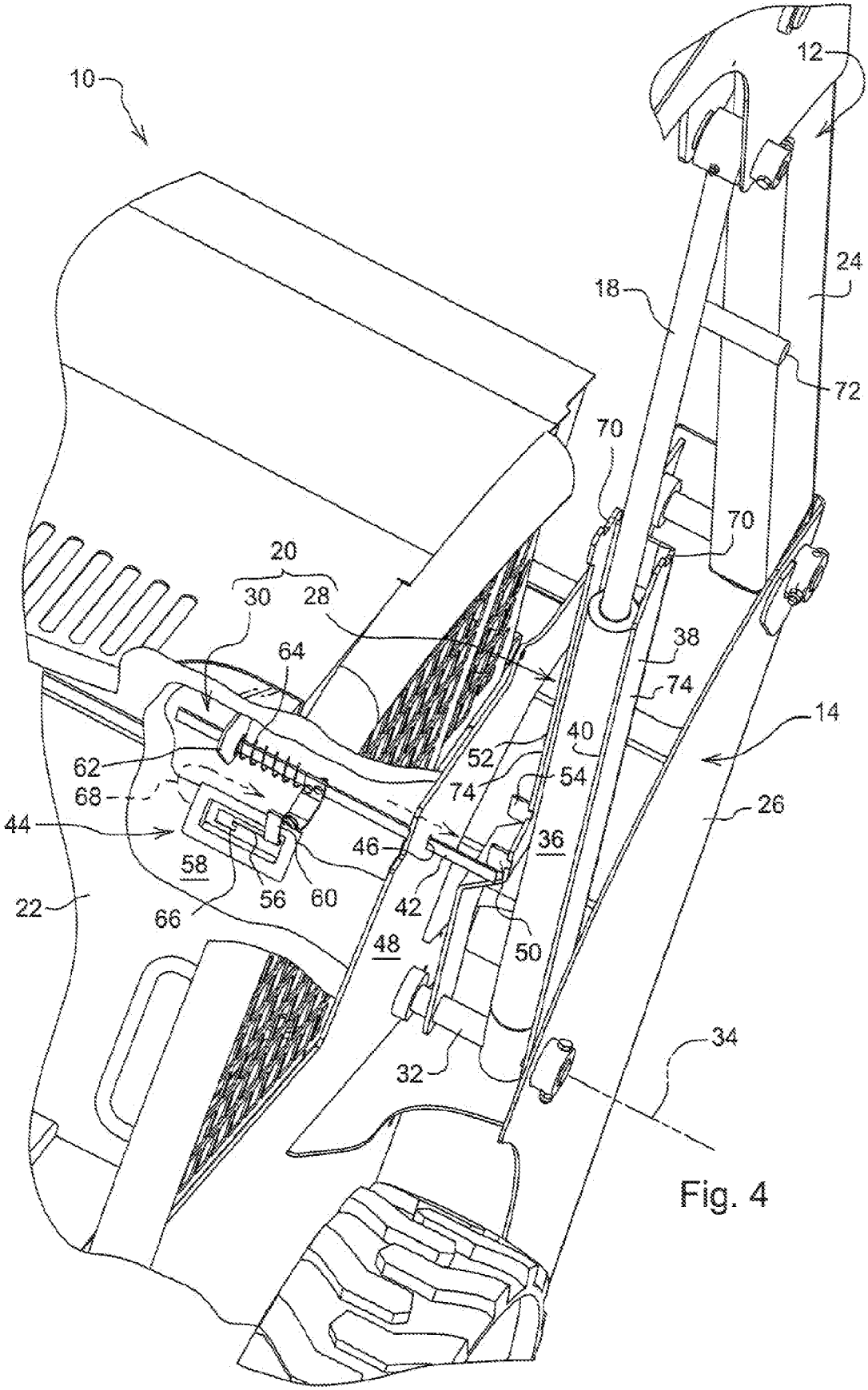
FIG. 4 is a perspective view, with portions broken away, showing the brace retainer moved to a deployed position extended relative to the machine body but spaced apart from a tab of a brace upon operation of the retainer actuator from the operator's station while the boom remains in the first raised boom position.

The brace retainer 42 is configured, for example, as a bar slidable trough an opening 46 formed in a side wall 48 of the machine body 14 between a retracted, non-use position (FIG. 3) and an extended, deployed position (FIG. 4). In the non-use position, the brace retainer 42 is retracted into the machine body 14 so as to allow unimpeded pivotal movement of the brace 28 and thus the boom 12. In the deployed position, the brace retainer 42 extends laterally from the side wall 48 of the machine body 14 for engagement with a tab 50 coupled to and extending laterally inwardly from an inboard side wall 52 of the brace 28 to retain the brace 28 in the boom-locking position (a tab 54 also coupled to side wall 52 may be used in place of tab 50 in some embodiments). In FIG. 4, the tab 50 is spaced apart from the brace retainer 42 since the boom is in the first boom raised position. The brace retainer 42 is biased toward the deployed position by the retainer actuator 44.

The retainer actuator 44 includes a slot 56 or other handle guide exemplarily formed in a rear wall 58 of the operator's station 22, a handle 60 coupled to the brace retainer 42 and extending through the slot 56 for movement therein and for access to the handle 60 by a human operator in the operator's station 22 for manual operation thereby, a fixed member 62 of the machine body 14 and a spring 64 or other biasing member acting between the fixed member 62 and the handle 60 so as to bias the brace retainer 42 toward the deployed position.

The slot 56 is generally J-shaped so as to have a notch or hook 66 formed therein. The retainer actuator 44 positions the brace retainer 42 in its non-use position when the handle 60 is captured in the notch 66 (FIG. 3). The spring 64 urges the brace retainer 42 to move through the opening 46 to the deployed position (FIG. 4), thereby actuating the brace retainer 42, when the human operator manually operates the handle 60 so as to remove it from the notch 66, allowing the handle 60 to be moved in the slot 56 toward the opposite end of the slot 56 along a path indicated by the arrow 68 by the spring 64.

Figure 5:
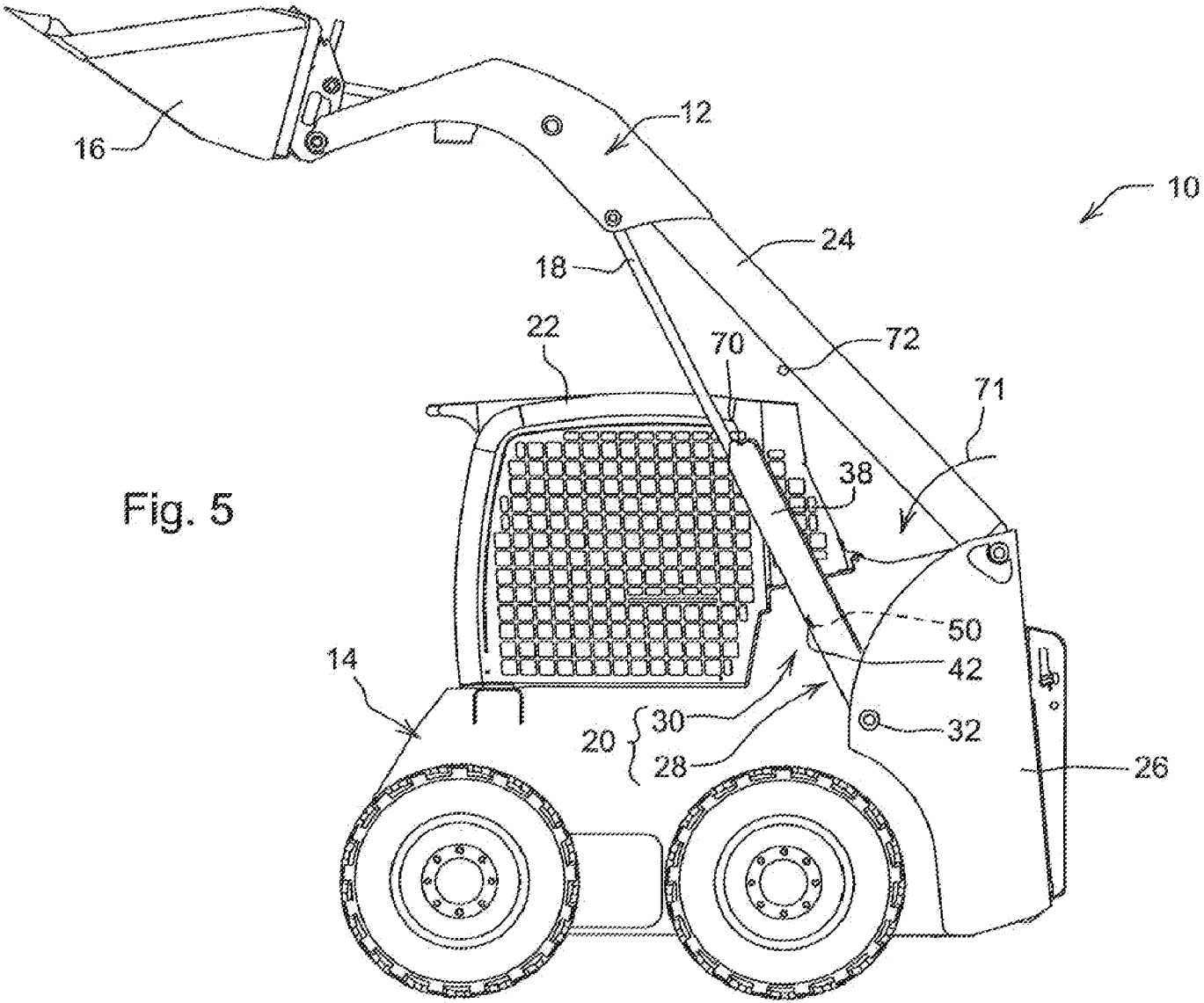
FIG. 5 is a side elevation view of the work machine showing partial lowering of the boom.
Figure 6:
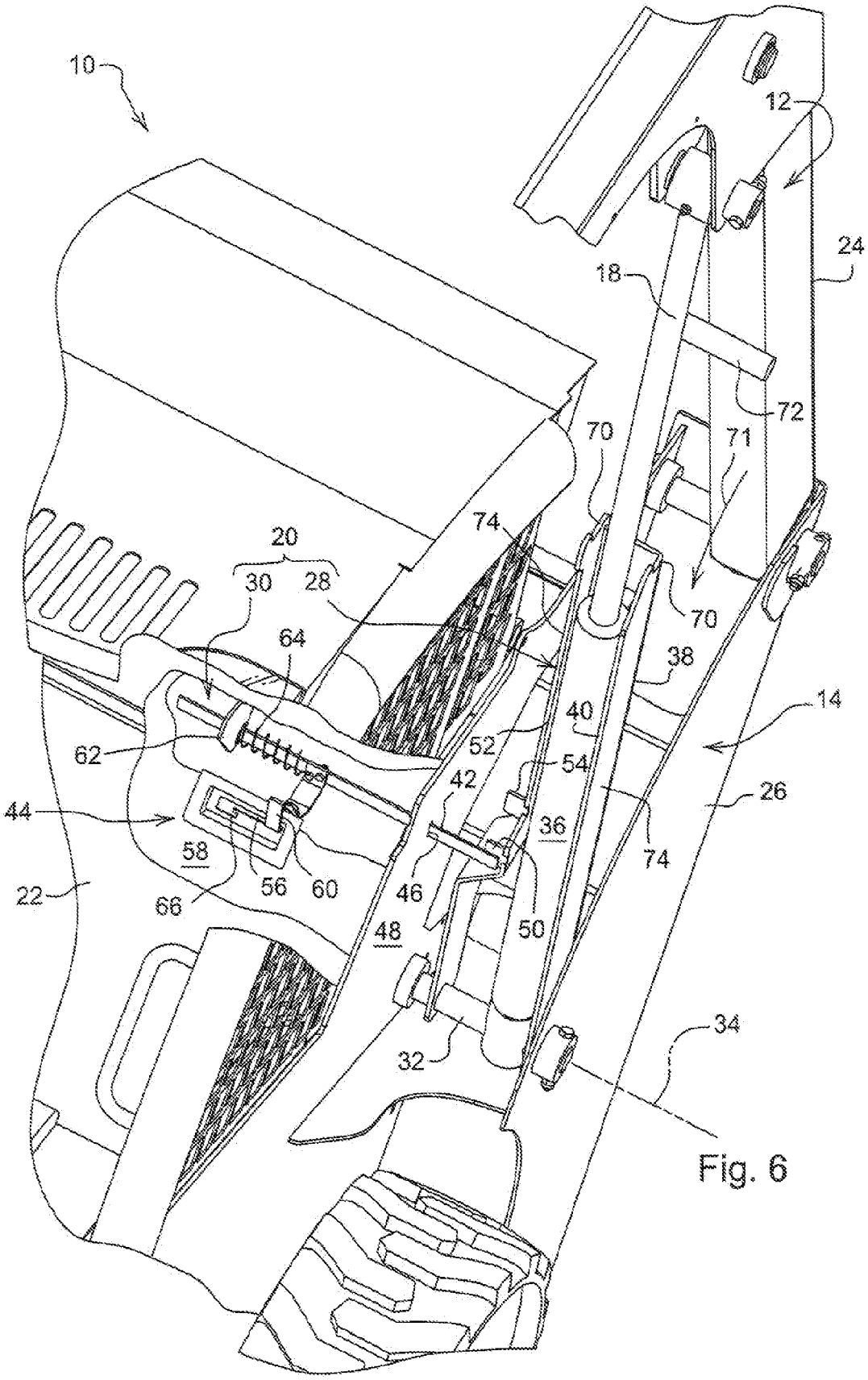
FIG. 6 is a perspective view, with portions broken away, corresponding to FIG. 5 and showing initial engagement of the brace retainer with the tab of the brace to retain the brace in a boom-locking position during the partial lowering of the boom

Referring to FIGS. 5 and 6, the boom 12 is shown being lowered partially from the first raised boom position (FIGS, 2-4) toward the second raised boom position (FIGS. 7 and 8) slightly lower than the first raised boom position in a direction 71. At first, the brace 28 continues to ride on the boom actuator 18 so as to lower therewith during such partial lowering of the boom 12. The brace 28 continues to lower in this manner until the tab 50 of the brace 28 comes into engagement with the deployed brace retainer 42, at which point the brace 28 ceases to lower any further assuming a boom-locking position (FIGS. 5-8). FIGS. 5 and 6 depict the work machine 10 at the moment of initial engagement between the brace retainer 42 and the tab 50 during the transition of the boom 12 from the first raised boom position to the second raised boom position. Such engagement between the brace retainer 42 and the tab 50 retains the brace 28 in the boom-locking position so that the brace 28 is blocked from further lowering relative to the machine body 14, and thus stationary relative thereto, while the boom 12 continues to lower toward the second raised boom position.

Referring to FIGS. 7 and 8, the brace 28 locks the boom 12 in the second raised boom position upon completion of the partial lowering of the boom 12 onto the brace 28. As alluded to above, the brace retainer 42 retains the brace in the boom-locking position after engagement between the brace retainer 42 and the tab 50 i.e., during the latter portion of the partial boom lowering, so that the boom 12 comes to rest on the brace 28 in the second raised boom position. The boom actuator 18 exits the channel 38 through the bottom opening 52 when the brace 28 is retained in the boom-locking position during this latter portion of the partial lowering of the boom 12 by the boom actuator 18.

The brace 28 is configured to receive the boom 12 thereon. Exemplarily the free end of the brace 28 has a notch 70 formed therein. The notch 70 receives therein a boss 72 when the boom 12 comes to rest on the brace 28. The notch 70 is formed, for example, in opposed side walls 74 of the channel 38. The boss 72 is configured, for example, as a bar welded to the underside of a side arm 24 of the boom 12.

The boom 12 can be unlocked by a reverse procedure. In particular the boom actuator(s) 18 raise the boom 12 off the brace 28 from the second raised boom position to the first raised boom position. In so doing, the tab 50 disengages the brace retainer 42. The operator then manually operates the handle 60 of the retainer actuator 44 so as to retract the brace retainer 42 from the extended, deployed position to the retracted, non-use position. The operator manipulates the handle 60 to position the handle 60 in the notch 66 so that the brace retainer 42 is retained in its on-use position against the biasing force of the spring 64. After the brace retainer 42 is moved out of the way, the boom 12 can be lowered back down to the lowered boom position, with the brace 28 resuming its position on the back of the barrel 36 so as to again ride thereon during pivotal movement of the boom 12.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The invention claimed is:

1. A method of operating a boom lock of a work machine, the work machine comprising an operator's station, a boom actuator, and a boom movable between a lowered boom position and a raised boom position using the boom actuator, the method comprising:

moving a brace to a boom-locking position using the boom actuator, actuating a brace retainer from the operator's station, retaining the brace in the boom-locking position using the brace retainer during a partial lowering of the boom onto the brace, and locking the boom in the raised boom position using the brace in its boom-locking position.

2. The method of claim 1, wherein the actuating comprises manually operating a retainer actuator, a handle of which is located in the operator's station.

3. The method of claim 1, wherein the actuating comprises moving the brace retainer in an opening in a side wall of a machine body of the work machine.

4. A work machine, comprising:

a machine body comprising an operator's station, a boom coupled to the machine body to move between a lowered boom position and a raised boom position, a boom actuator coupled to the boom to move the boom between the lowered and raised boom positions, a brace overlying the boom actuator so as to be movable with the boom actuator in a travel path to a boom-locking position in which the brace is arranged to lock the boom in the raised boom position, a brace retainer arranged to move relative to the machine body between a deployed position extending into the travel path and a non-use position out of the travel path, wherein in the deployed position the brace retainer is arranged to engage and retain the brace in the boom-locking position during a partial lowering of the boom onto the brace so as to assume the raised boom position, and a retainer actuator coupled to the brace retainer and operable from the operator's station to move the brace retainer to the deployed position to retain the brace in the boom-locking position.

5. The work machine of claim 4, wherein the brace and the boom actuator are coupled to a mount of the machine body for pivotable movement about a common pivot axis.

6. The work machine of claim 4, wherein the brace is arranged to ride on the boom actuator upon a change in elevation of the boom by the boom actuator.

7. The work machine of claim 6, wherein the brace comprises a channel arranged to receive the boom actuator therein when the brace rides on the boom actuator and a bottom opening formed in the channel through which the boom actuator exits the channel when the brace is retained in the boom-locking position by the brace retainer during the partial lowering of the boom to the raised boom position by the boom actuator.

8. The work machine of claim 4, wherein the brace comprises a tab, the brace retainer comprises a slidable bar arranged to slide in an opening formed in a side wall of the machine body between the deployed position for engagement with the tab to retain the brace in the boom-locking position and the non-use position, and the slidable bar is biased to the deployed position.

9. The work machine of claim 4, wherein the boom comprises a side arm positioned laterally outwardly from each side of the operator's station and a boss coupled to one of the side arms, and the brace comprises a notch formed in an end of the brace for receiving the boss therein to lock the boom in the raised position.

10. The work machine of claim 4, wherein a handle of the retainer actuator is located in the operator's station.

11. The work machine of claim 4, comprising a machine body, wherein the brace retainer is arranged to move relative to the machine body between the deployed position for engagement with the brace to retain the brace in the boom-locking position and the non-use position.

12. The work machine of claim 11, wherein the retainer actuator comprises a slot, a handle coupled to the brace retainer and extending through the slot into the operator's station for movement in the slot, a fixed member coupled to the machine body against movement relative thereto, and a spring acting between the fixed member and the handle to bias the brace retainer toward the deployed position.

13. The work machine of claim 4, wherein the work machine is a skid steer.

14. The method of claim 1, wherein the brace overlies the boom actuator, and the moving comprises pivoting the brace.

15. The method of claim 14, wherein the pivoting comprises pivoting the brace about a pivot axis in response to pivoting of the boom actuator about the pivot axis.

16. The method of claim 1, wherein the actuating comprises deploying the brace retainer into a pivot path of the brace.

17. The method of claim 16, wherein the moving comprises lowering the brace into engagement with the brace retainer after deployment of the brace retainer.

18. The work machine of claim 1, wherein the brace is positioned on boom actuator except when the brace is positioned in the boom-locking position and the boom is positioned on the brace.

19. The work machine of claim 7, wherein the channel comprises an inboard side wall, outboard side wall, and a top wall interconnecting the inboard and outboard side walls, and the inboard side wall, the outboard side wall, and the top wall cooperate such that the channel is inverted U-shaped and opens downwardly at the bottom opening.

* * * * *